US007699287B2

(12) United States Patent
Castor

(10) Patent No.: US 7,699,287 B2
(45) Date of Patent: Apr. 20, 2010

(54) SUPPORT DEVICE FOR LIFE RAFT CONTAINER

(75) Inventor: Philippe Castor, Auzeville-Tolosane (FR)

(73) Assignee: Zodiac International (FR)

( * ) Notice: Subject to any disclaimer, the term of this patent is extended or adjusted under 35 U.S.C. 154(b) by 32 days.

(21) Appl. No.: 11/821,172

(22) Filed: Jun. 22, 2007

(65) Prior Publication Data

US 2008/0006755 A1 Jan. 10, 2008

(30) Foreign Application Priority Data

Jun. 22, 2006 (FR) ..... 06 05615
Oct. 16, 2006 (FR) ..... 06 09057

(51) Int. Cl.
*A47B 97/00* (2006.01)

(52) U.S. Cl. ..... 248/503; 180/68.5; 248/500

(58) Field of Classification Search ..... 248/499, 248/500, 503, 505, 510, 691, 154, 201, 346.03, 248/346.07, 346.5; 224/448, 454, 456, 459, 224/461, 533, 536, 440, 441, 42.38, 42.2
See application file for complete search history.

(56) References Cited

U.S. PATENT DOCUMENTS 1,500,511 A * 7/1924 McKenney ..... 224/42.38
1,579,770 A * 4/1926 Kelly ..... 224/42.38
1,710,093 A * 4/1929 Kintzele ..... 224/42.38
4,556,187 A * 12/1985 McLin ..... 248/503
5,222,711 A * 6/1993 Bell ..... 248/503
5,228,532 A * 7/1993 Browning et al. ..... 180/68.5
5,377,947 A * 1/1995 Johnson ..... 248/503
6,871,829 B2 * 3/2005 Shannon, Jr. ..... 248/505

* cited by examiner

*Primary Examiner*—J. Allen Shriver, II
*Assistant Examiner*—Alaeddin Mohseni
(74) *Attorney, Agent, or Firm*—Dean W. Russell; Kristin M. Crall; Kilpatrick Stockton LLP

(57) ABSTRACT

Support device (1) for a container enclosing a pneumatic life raft, comprising a support plate (2) and means (3) for stowing the container on the plate which comprises two separate bases (4) located opposite one another, in line with one another and at a distance from one another; the stowing means being able to comprise a rigid bar (5) of variable length extending from one base to the other by spanning the container with one end (6) articulated in rotation (11, 12) on a base (4*a*) and its other end (7) which may be fixed by releasable fixing means to the other base (4*b*); blocking means (8) blocking the container transversely to the bar; said support device may support containers of various dimensions.

10 Claims, 5 Drawing Sheets

SUPPORT DEVICE FOR LIFE RAFT CONTAINER

CROSS REFERENCE TO RELATED APPLICATIONS

This application claims priority to French Patent Application No. FR 0605615 filed on Jun. 22, 2006 and French Patent Application No. FR 06 09057 filed on Oct. 16, 2006, the contents of which are incorporated herein by reference.

FIELD OF THE INVENTION

The present invention generally relates to the field of life rafts and it relates more particularly to support devices capable of supporting a container enclosing at least one pneumatic life raft in the uninflated and folded state, said device comprising a support plate capable of supporting said container and stowing means capable of fixing the container to the support plate.

The invention relates, in particular, although not exclusively, to such devices intended for yachting, i.e. to the support of containers which enclose rafts of reduced size or relatively reduced size (of a capacity in the order of a dozen people which is not usually exceeded) and thus of relatively low bulk and relatively low weight.

BACKGROUND OF THE INVENTION

Various embodiments of support devices for life raft containers are known which may, in particular, be intended to be fixed (for example by screwing) to the bridge, the pulpit, the binnacle roof, the upper stern or an equivalent superstructure of a yacht.

In said known devices, the support plate, whatever its shape (in particular a basket-shaped plate consisting of shaped metal sections) is dimensionally adapted to the shape and dimensions of a specific container, such that it is necessary to design as many support plates as there are containers of different dimensions. Being of limited distribution due to their specific shape, such support plates have a high cost price.

Certain plates of extremely simplified structure do not achieve a sufficiently efficient retention of the container which risks being carried away by, for example, a violent wave.

The fixing of the container to the support plate is generally carried out using straps fixed to the support plate by being tightened over the container. The drawback of the fixing method lies in the poor performance of the straps over time in the presence of sunshine, rain and the sea air. The straps loosen and have to be retensioned regularly; they deteriorate rapidly and have to be replaced regularly.

Sometimes, the fixing of the container to the support plate is carried out by means of one or more metal bars fixed to the plate, spanning the container. The drawback with this solution, once again, lies in the fact that the bars are dimensionally adapted to the shape and dimensions of a specific container.

SUMMARY OF THE INVENTION

There is therefore an expectation from the practice for support devices for life raft containers which efficiently retain the container, which have a cost price which is as low as possible during manufacture, and which only require minimum maintenance during use. The object of the invention is to propose a support device for life raft containers of improved design which responds to the various demands of usage better than those currently known.

To these ends, the invention proposes a support device for supporting a container enclosing at least one pneumatic life raft in the uninflated and folded state, said device comprising a support plate capable of supporting said container and stowing means capable of fixing the container to the support plate, said device, being arranged according to the invention, being characterized in that the support plate comprises two separate, generally plate-shaped bases, arranged opposite one another in line with one another and at a distance from one another.

As a result of these arrangements, the two bases may be arranged at distances which are adjustable relative to one another according to a corresponding dimension of the container such that the support device may support containers of various corresponding dimensions (lengths).

In a preferred embodiment, it is provided that the stowing means extend from one base to the other and that transverse blocking means of the container are capable of blocking the container in a direction transverse to the extent of the stowing means.

The support device of the invention is easily adaptable to the shapes which the life raft containers may have. In particular, if the device is intended to support containers of generally overall parallelepipedal shape, in particular rectangular parallelepipedal shape which is the most common shape of life raft container used in the field of yachting, it is provided that the transverse blocking means comprise at least two pairs of lateral blocks respectively fixed to the two bases, the two blocks of one pair being fixed to one respective base on both sides of the dimension of the container which is transverse to the extent of the stowing means. In practice, therefore, each base may comprise at least one central block and two lateral blocks not aligned with the central block, said blocks being capable of cooperating with one respective end of the container.

The pneumatic life rafts intended for yachting have relatively restricted capacities (generally in the order of four people up to a number not exceeding ten people) and the capacities of the various types of raft in the uninflated and folded state do not differ significantly. As a result, the capacities of the containers of parallelepipedal shape intended to enclose said various types in the uninflated and folded state may, in principle, be obtained without difficulty by a dimensional adjustment according to one dimension (length or height) or possibly two dimensions (length and height). The support device which is adjustable dimensionally in length and/or in height which is described above has to be able to receive any one of said containers which, therefore, all have the same transverse dimension (width). The support device according to the invention, which makes it possible to meet these needs, is distinguished by its simple structure, the small number of component parts and the ease of dimensional adjustments.

However, it is conceivable that there is the requirement, at least for meeting specific needs, of making use of containers liable to have different transverse dimensions (widths), notwithstanding the two other dimensions (length, height). To meet these needs, the invention proposes that the support device comprising the above arrangements which are appropriate for containers of substantially parallelepipedal shape is arranged so that each base is in the form of two separate, generally plate-shaped half-bases, arranged at a distance from one another in a direction transverse to the extent of the stowing means and that at least one stowing means is mounted on a half-base, and by preferably providing, in order to ensure stable and reliable stowing of the container, that two stowing means are respectively mounted on the two constituent half-bases of one base. The support device thus arranged may therefore have capacities for adjustment in the three dimensions, but at the price certainly of an increased number of component parts and thus of a higher cost price.

In contrast, if the support device is intended to support containers of generally overall axisymmetric cylindrical shape, it is provided that the transverse blocking means comprise two cradles respectively fixed to the two bases.

Whatever the design of the support device, its manufacture may be simple and only require basic tooling (stamping, folding, drilling) if it is provided that each base, respectively each half-base, is formed in a cut and folded sheet metal plate and that the blocking means are integral tabs projecting over one edge or the edges and lifted upwards.

In one possible embodiment, the stowing means comprise at least one rigid bar extending from one base to the other, one end of the rigid bar being fixed to a base in a manner articulated in rotation and the other end of the rigid bar being able to be fixed by releasable fixing means to the other base, said rigid bar having a variable length which may be adjusted according to the distance between the two bases and being formed, in the stowed position, for spanning the container and preventing said container from lifting up from the plate. Thus, the support device may have a wide universal application which may possibly be further increased by providing that the at least one rigid bar has a variable adjustable height, such that the support device may also support containers having various heights. In other words, the support device according to the invention may accept containers which, all having the same transverse dimension (width), may have any length and any height included in the respective ranges predetermined by the structure of the device. If each base is in the form of a part in one piece, the transverse dimension (width) is fixed for all acceptable containers: this does not constitute an awkward restriction as changing the volume of the container relative to the capacity of the raft may easily be obtained by adapting the length and/or possibly the height of the support device. Otherwise, bases in the form of two half-bases as described above may be used, so that the device may be adapted in the three dimensions: in this case, it may be provided that at least one rigid bar is mounted on a half-base, but preferably, in order to ensure stable and reliable stowage of the container, two rigid bars are respectively mounted on the two constituent half-bases of a base.

Such a support device becomes universally applied and, as a result, being manufactured in large quantities, its cost price is markedly reduced.

Moreover, the fixing of the container no longer requires straps, so that the restrictions associated therewith are eliminated. The maintenance is reduced.

In contrast, if the support device is intended to support containers of generally overall axisymmetric cylindrical shape, it is provided that the transverse blocking means comprise two cradles fixed respectively to the two bases.

Whatever the design of the support device, its manufacture may be simple and only require basic tooling (stamping, folding, drilling) if it is provided that each base, respectively each half-base, is formed in a cut and folded sheet metal plate and that the blocking means are integral tabs projecting over one edge or the edges and lifted upwards.

If it is desired to improve further the retaining of the container on the support device, an arrangement of the container may further be provided so that the transverse blocking means comprise at least one indentation provided in the container and in which at least one part of the rigid bar is received.

The design and the production of the rigid bar may give rise to numerous variants. In one embodiment which is easily manufactured and implemented and, for this reason, preferred, it is provided that the rigid bar is generally L-shaped with a vertical limb having one free end which is fixed freely rotatably to a base, respectively a half-base, and with a horizontal arm which extends said limb and which extends over the container over the entire corresponding dimension thereof, said arm having a variable length which may be adapted to the corresponding dimension of the container and having one free end which is capable of being fixed releasably to the other base, respectively the other half-base. In this case the arm of the rigid bar preferably has a telescopic structure.

In one such embodiment, it may be advantageously provided that the vertical limb of the rigid bar has a telescopic structure.

The releasable fixing means implemented for fixing the rigid bar to the opposing base, respectively the opposing half-base, may be of any appropriate type according to the distance between said opposing base and the end of the bar; generally said means may consist of a chain, a cable or the like. It will be noted, however, that the design of the support device according to the invention allows the releaseable fixing means to incorporate hydrostatic casting-off means.

In an embodiment which is even more simple and more economical in design, and which for this reason is currently preferred, it is provided that the stowing means comprise at least one deformable cable extending from one base to the other, one end of the cable being able to be fixed by releasable fixing means to a base, said cable having a length which may be adjusted according to the distance between the two bases, in the stowed position, for spanning the container and preventing said container from lifting up from the plate.

A simple way of allowing an adaptation of the cable to the shape of the container may consist in that the cable comprises separable sections allowing its length to be adjusted.

To provide a reliable stowing of the container whilst maintaining an extremely simplified structure, it is provided that the cable is doubled up substantially in a V-shape, with the point of the V fixed to a base and the two free ends of the V fixed to the other base and joined to one another by adjustable tensioning means capable of allowing the cable to be tensioned in the stowed position.

It will be emphasized that the device according to the invention uses a reduced number of metal parts, which are of simple manufacture only requiring conventional tooling. The manufacture of said parts does not require skilled labour and the production costs are reduced.

BRIEF DESCRIPTION OF THE DRAWINGS

The invention will be better understood by reading the detailed description which follows of certain preferred embodiments, given solely by way of non-limiting examples. In this description, reference is made to the accompanying drawings, in which.

DETAILED DESCRIPTION OF THE INVENTION

Figure 1A:
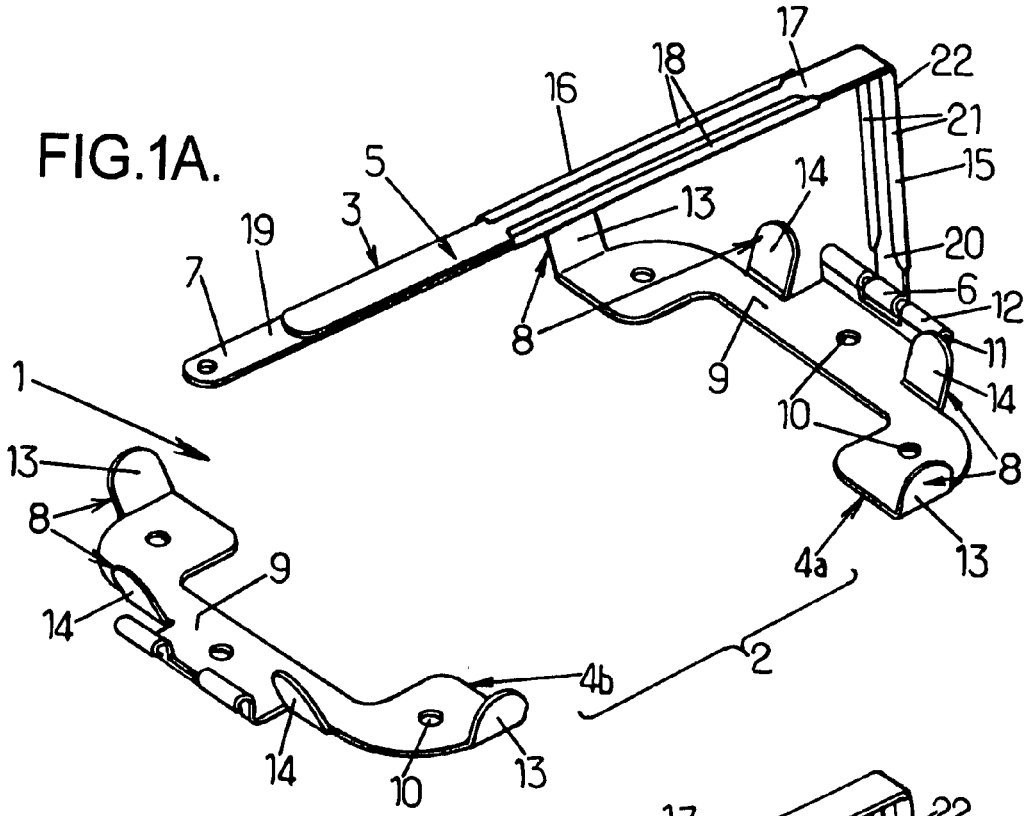
FIGS. 1A and 1B are perspective views of a first embodiment of a support device for life raft containers arranged according to the invention, shown respectively in two configurations of use.

By referring firstly to FIG. 1A, a support device is shown there, denoted in its entirety by the reference numeral 1, capable of supporting a container (not shown in this figure) enclosing at least one pneumatic life raft in the uninflated and folded state. The support device 1 comprises a support plate, denoted in its entirety by the reference numeral 2, capable of supporting said container and stowing means, denoted in their entirety by the reference numeral 3, capable of fixing the container to the support plate 2.

According to the invention, the support plate 2 comprises two separate, generally plate-shaped bases 4 (denoted respectively 4*a* and 4*b*), arranged opposite one another in line with one another and at a distance from one another.

Preferably, the stowing means 3 extend from one base 4*a* to the other 4*b*.

Figure 1B:
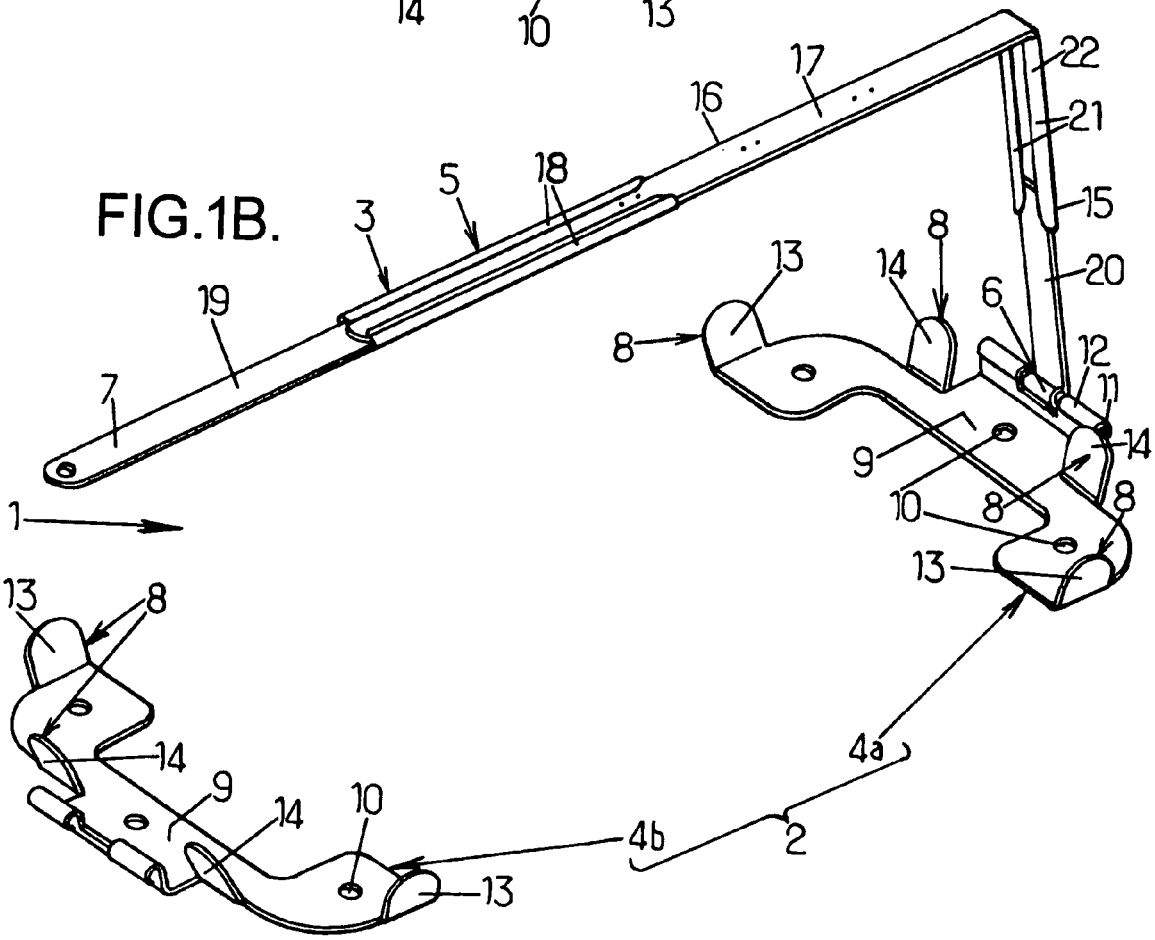

In the embodiment of the support device of the invention as illustrated in FIGS. 1A and 1B, the stowing means 3 comprise at least one rigid bar 5 extending from one base 4 to the other. One end 6 of the rigid bar 5 is fixed to one 4*a* of the bases in a manner articulated in rotation. The other end 7 of the rigid bar 5 may be fixed by releasable fixing means, of which one example will be given below, to the other base 4*b*. The rigid bar 5 has a variable length which may be adjusted according to the distance between the two bases 4*a*, 4*b* and is formed, in the stowed position, for spanning the container and preventing said container from lifting up from the plate as will be explained below.

Finally, transverse blocking means 8 of the container are capable of blocking the container in a direction transverse to the extent of the stowing means 3.

Hereinafter, it will be assumed that the stowing means 3 extend approximately according to one dimension of the container which will be denoted the length of the container, whilst the dimension transverse to the extent of the stowing means 3 and parallel to the support plate will be denoted the width of the container (in the case of a container of parallelepipedal shape, in particular rectangular parallelepipedal shape). The dimension of the container which is substantially perpendicular to the two preceding dimensions will be known as the height of the container (in the case of a container of parallelepipedal shape) or diameter of the container (in the case of a cylindrical container).

The two bases 4*a*, 4*b* may be manufactured in a strictly identical manner, such that they are perfectly interchangeable; their manufacturing cost is thus reduced. Said bases which have to support and retain the container enclosing the life raft which, depending on the model and capacity, may be heavy, must be mechanically resistant. It is therefore preferable that they are of metal. They may advantageously be manufactured by die stamping, cutting or folding a blank made of stainless steel or aluminium sheet, so that all the constituent parts are formed without requiring repeated machining.

In the embodiment which is illustrated in FIG. 1A, each base 4 comprises a substantially planar plate-shaped part 9 which is appropriate for resting on the part of the boat intended for its support (for example the bridge, the pulpit, the upper stern, etc.) and to be fixed thereto, for example by screwing (to this end, the plate 9 may be perforated in the appropriate positions, as shown by the holes 10).

Centrally on its transverse external edge (i.e. extending along the width of the container), the plate 9 may have a projecting cut-out zone which, after appropriate folding, forms a bearing 12 capable of receiving a pivot pin 11 for the aforementioned rigid bar 5, when such a bar is used to form the stowing means 3.

In the case where the support device 1 is intended to support containers of generally overall parallelepipedal shape, in particular rectangular parallelepipedal shape, the transverse blocking means 8 may advantageously comprise, in a simple manner, at least two lateral blocks 13 respectively fixed to each base 4, the two blocks 13 being fixed to the base respective symmetrically on its two edges extending parallel to the length of the container. Preferably, however, the number of blocks may be greater and each base 4 may comprise at least one block 14 at the end (two in the example illustrated in FIG. 1A) and two lateral blocks 13 not aligned with the end block 14.

In the preferred method of manufacturing more specifically considered above, each block 13, 14 is formed by a projecting cut-away zone on the plate 9 and folded back upwards in the form of an approximately vertical integral tab, as visible in FIG. 1A.

As for the stowing means 3 which, in the embodiment more specifically considered in relation to FIGS. 1A and 1B, comprise at least one rigid bar 5 as mentioned above, any arrangement capable of ensuring the required function of the stowing of the container may be used. In particular, a single rigid bar might be conceived of generally inverted U-shape, spanning the container from one base to another, or even two rigid L-shaped bars supported respectively by the two bases and joined to one another above the container.

Nevertheless, the solution which currently appears to be the simplest for manufacture, assembly and usage consists in implementing a single rigid L-shaped bar 5. Thus, this rigid L-shaped bar 5 has a vertical limb 15 having its free end 6, which is fixed by the aforementioned pin 11, freely rotatable to the base 4*a*. The rigid bar 5 also has a horizontal arm 16 which extends said limb 15 approximately at right angles and which is capable of extending over the container over the entire length thereof; the arm 16 has a variable length which may be adapted to the length of the container and its free end 7 is capable of being fixed releasably to the other base 4*b*.

The adjustment of the length of the arm 16 may be carried out in any appropriate manner within the context of the present invention. Nevertheless, one solution which is very easily implemented by the user and which does not lead to highly complicated manufacture consists in that the arm 16 has a telescopic structure. To this end, the arm 16 may comprise a principal section 17 which is fixed to the limb 15 and which is stationary; a sliding section 19, of which the free end constitutes the aforementioned end 7 of the rigid bar 5, may be formed, over at least one part of its length, with two lateral flanges folded back so as to form a slider 18 in which the principal section 17 is engaged (the arrangement of the two sections also being able to be reversed). Possibly, mutual blocking means of the two sections 17 and 19 may be provided, either in any position of adjustment or in predetermined positions corresponding to predetermined lengths of the containers.

To increase further the universality of application of the support device according to the invention, it may also be provided that the blocking means are arranged so as to accept containers of various heights and to this end the at least one rigid bar 5 has a variable adjustable height. In other words, within the context of the single rigid L-shaped bar 5 more specifically conceived in the preferred embodiment, disclosed above and illustrated in FIG. 1A, the limb 15 of the rigid bar 5 has a height which is adjustable. For the same reasons as those explained referring to the arm 16, it is preferable that the limb 15 is arranged in telescopic form. To this end, the arrangement disclosed above may be extended to the form of the arm 16. Thus, it is provided that the limb 15 is formed by a fixed section 20 of which the free end constitutes the above end 6 which is articulated on the base 4*a*; said section may be engaged to slide freely in a slider 21 defined by two lateral flanges belonging to a sliding section 22, which is fixed at right angles to the aforementioned principal section 17 of the arm 16.

In FIG. 1A, the support device 1 is shown in its minimum configuration, i.e. with the limb 15 and the arm 16 of the rigid bar 5 positioned in their respective minimum extensions. The support device 1 thus formed may receive a container of small dimensions both in length and in height. The base 4*b* is arranged at a distance from the base 4*a* which corresponds to the short length of the container.

In FIG. 1B, the support device 1 is shown in its maximum configuration, i.e. with the limb 15 and the arm 16 of the rigid bar 5 positioned in their respective maximum extensions. The support device 1 thus formed may receive a container of large dimensions both in length and in height. The base 4*b* is arranged at a distance from the base 4*a* which is corresponds to the long length of the container.

Taking account of the constructive solutions adopted for forming the arm 16 and the limb 15, the support device may be adjusted in all intermediate dimensional configurations in length and/or in height, the adjustment of the arm and that of the limb being independent of one another.

The support device 1 illustrated in FIGS. 1A and 1B is provided for receiving containers all having the same width. To receive containers having different widths, it is necessary to design bases designed in an identical manner, but having adapted widths.

Figure 2:
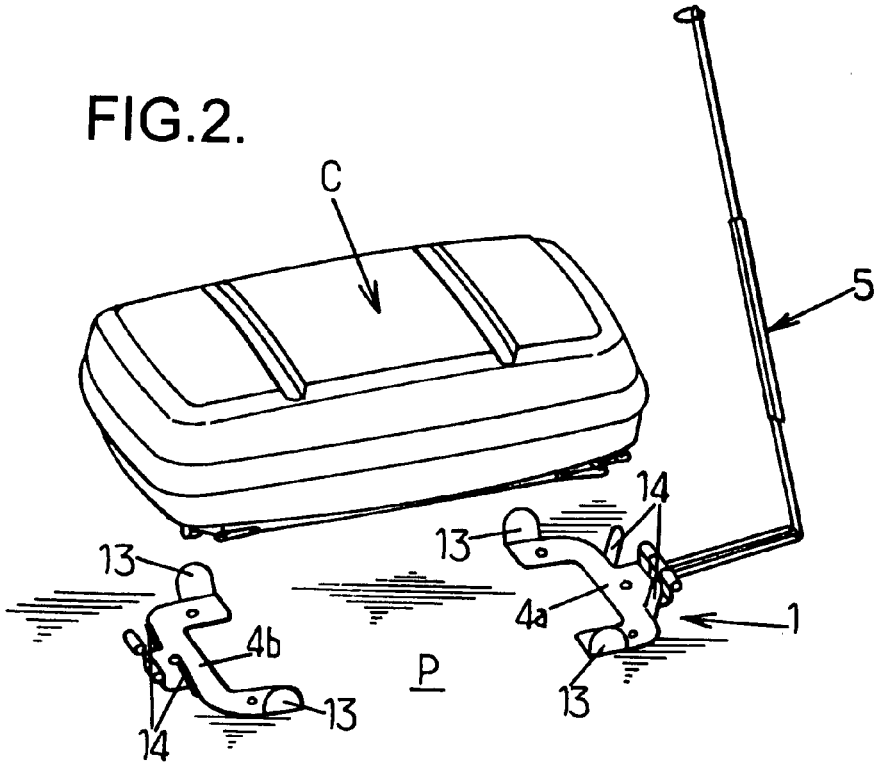
FIG. 2 is a perspective view of the device of FIGS. 1A and 1B shown in the position which it occupies during the positioning of a container.

For the implementation, the bases 4*a*, 4*b* having a width appropriate to the width of the container are mounted and fixed, for example by screwing, to the desired position on the boat, for example on its bridge P, with a mutual separation appropriate to the length of the container C. The bar 5 carried by the base 4*a* is lifted as shown in FIG. 2 and the container C is deposited on the support defined by the bases 4*a*, 4*b* inside the contour defined by the retaining blocks 13, 14.

Figure 3:
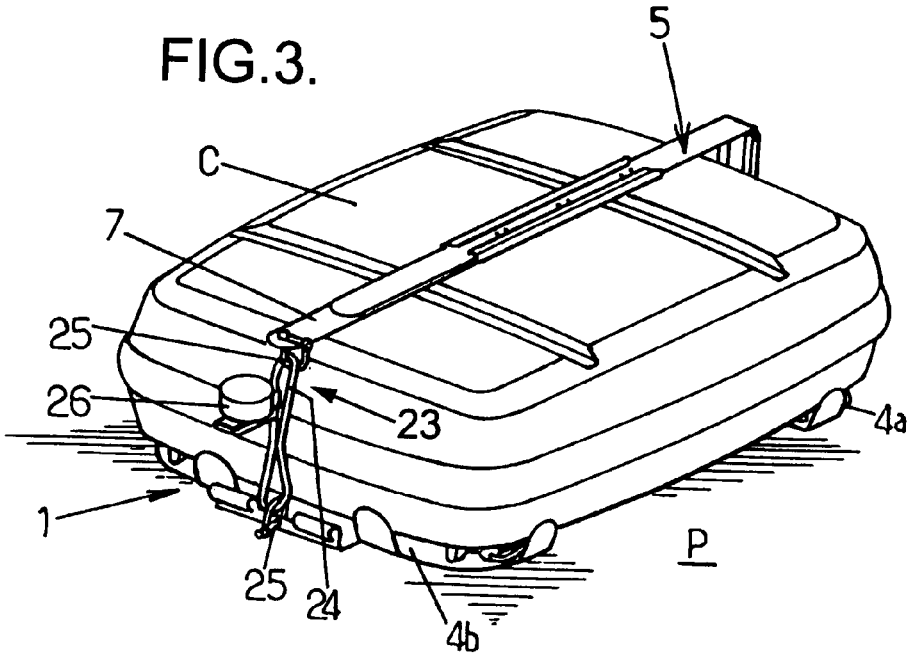
FIG. 3 is a perspective view of the device of the preceding figures in the functioning position with a container in place.

Then, the bar 5, previously adjusted in length and possibly in height, is folded down over the container C as shown in FIG. 3. Releasable fixing means 23 are then adjusted at the end 7 of the bar 5 for fixing it to the base 4*b*, such that it may not be lifted up and that the container C is fastened to the support device 1 and thus to the boat. The fixing means 23 may be of any type appropriate to the function(s) required. In the example illustrated in FIG. 3, the fixing means 23 are shown as being formed by a connection 24 such as a chain, engaged through shackles 25 fixed to the end 7 of the bar 5 and to the base 4*b* and held fastened onto itself by an appropriate security locking member 26, which may be of any appropriate type, with manual or automatic, for example hydrostatic, actuation.

Possibly, in particular if the device is intended to receive containers having a substantial width and/or significant weight, it is possible to reinforce the stowing means in particular by providing a plurality of parallel bars 5, which are separate or coupled mechanically, so as to fasten the container in a more stable manner.

The arrangements which have been disclosed above make it possible to design a support device which is appropriate for receiving containers of substantially parallelepipedal shape differentiated by one dimension (length) or two dimensions (length and height) but all having the same transverse dimension (width) which in principle allows all the requirements necessary for yachting to be met (pneumatic life rafts thus having a capacity of approximately 4 to 12 people).

Figure 5:
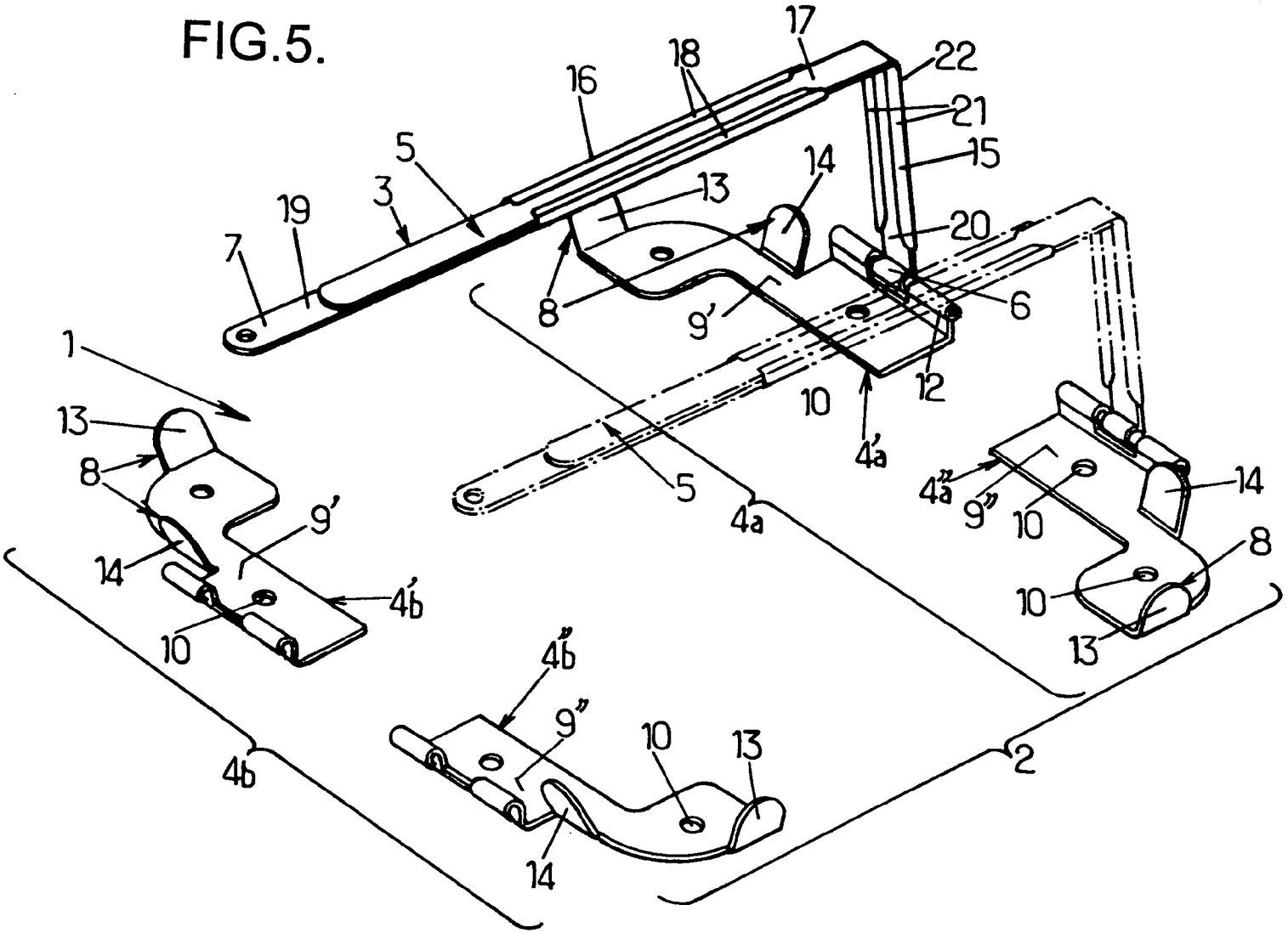
FIG. 5 is a similar perspective view to FIG. 1A showing a possible variant of the support device according to the invention.

Nevertheless, by way of a variant, the support device according to the invention may, if the need arises, be arranged for also receiving containers of substantially parallelepipedal shape having different transverse dimensions (widths). As illustrated in FIG. 5, each base 4 has the form of two separate, generally plate-shaped half-bases 4', 4", arranged at a distance from one another according to a direction transverse to the extent of the bar 5. Thus the base 4*a* is composed of the two half-bases 4*a*', and 4*a*" and the base 4*b* is composed of two half-bases 4*b*' and 4*b*". A rigid bar 5 is mounted in the manner disclosed above on a half-base 4*a*'. Each half-base is equipped with the aforementioned retaining blocks 13, 14.

It will be noted that in the arrangement shown in FIG. 5, the bar 5 is no longer arranged centrally relative to the container but is offset towards one edge thereof; as a result there is the risk of the stowing of the container being insecure. To achieve reliable stowing it is thus advantageous to provide a second bar 5 (shown in dotted lines on FIG. 5) mounted on the other half-base 4*a*" so as to extend parallel to the first bar.

To simplify the manufacture, the assembly and the performance of the groups of parts, the half-bases 4', 4", as visible in FIG. 5, are produced in a symmetrically identical manner, each in particular being provided with a bearing 12 equipping a plate-shaped part 9', 9" of which the edges are provided with clamping blocks 13, 14.

In the same manner as the integral bases 4, the half-bases 4', 4" may be manufactured in a cut and shaped sheet metal plate with the bearings 12 and the clamping blocks 13, 14 formed in the form of projecting integral tabs formed by folding.

The arrangements of the invention which have been disclosed above have been shown more particularly in relation to containers of generally parallelepipedal shape, in particular rectangular parallelepipedal shape, as it is this type of container which is most commonly used within the scope of yachting, more specifically, although not exclusively, targeted by the invention.

Figure 4:
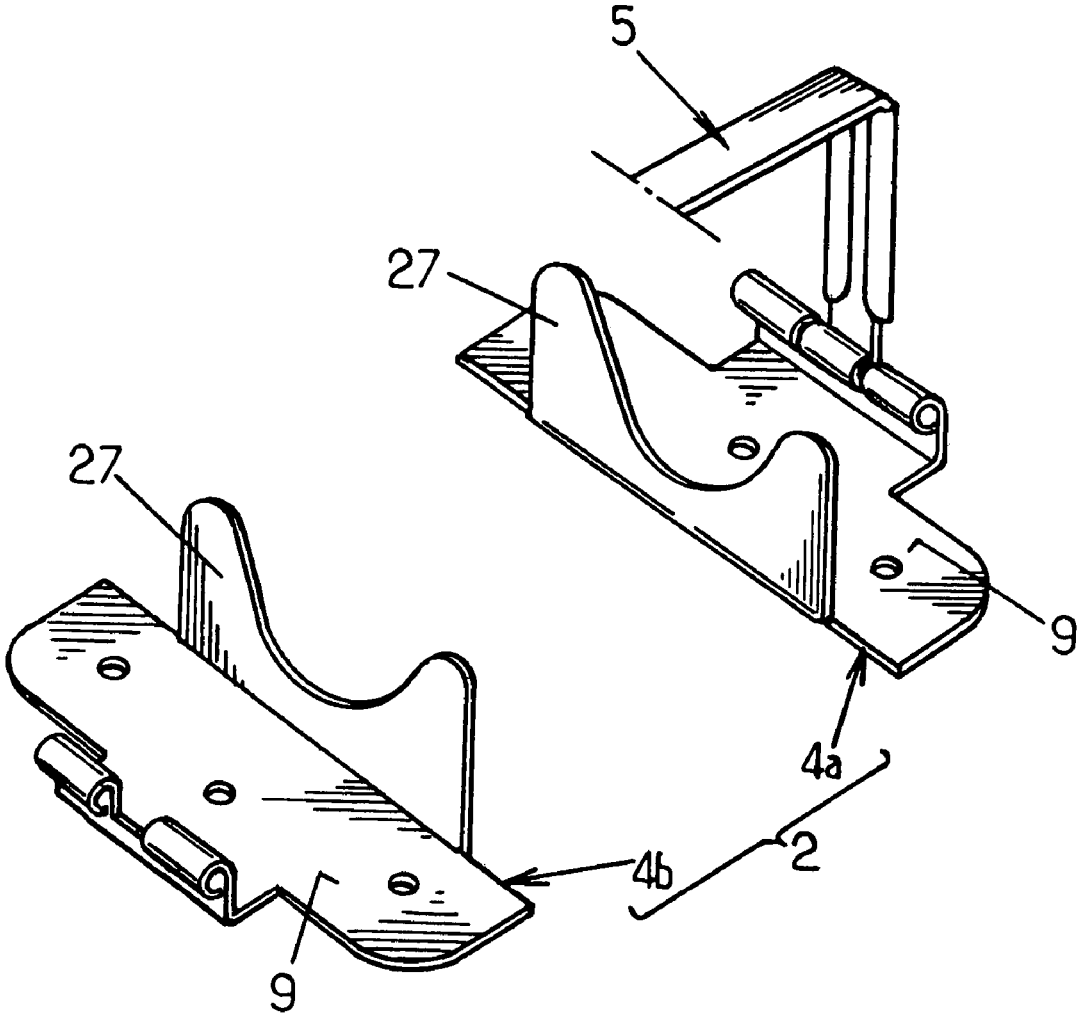
FIG. 4 is a partial perspective view of a variant of a device according to the invention arranged to receive a container of generally axisymmetric cylindrical shape.

Nevertheless, the arrangements according to the invention may also be applied as regards containers of generally axisymmetric cylindrical shape. In this case, as illustrated in FIG. 4, the blocking means 8 respectively comprise two cradles 27 arranged respectively on the two bases 4. Each cradle 27 may be formed integrally, in the form of a projecting area, of which the edge is cut away in the shape of a circular arc, which is formed on the internal transverse edge of the plate 9 and which is folded upwards approximately perpendicular to the plate 9.

In this context, it may be advantageous to complement the transverse blocking means 8 by providing at least one continuous or discontinuous indentation extending longitudinally to the upper part of the container, in which the rigid bar 5 is entirely or partially received (not shown), such an arrangement being also able to be conceived for the parallelepipedal containers.

Figure 6:
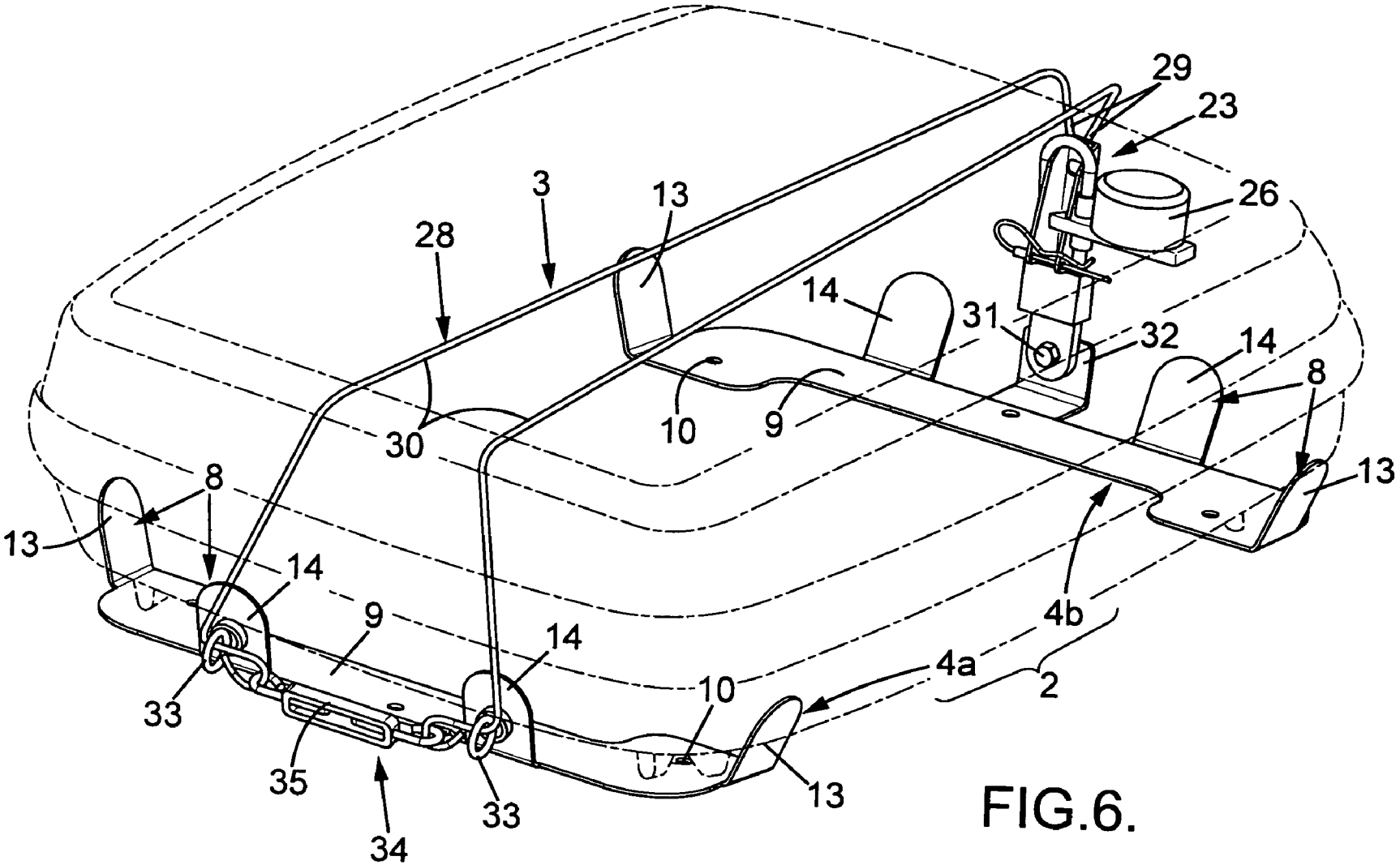
FIG. 6 is a perspective schematic view showing a further preferred embodiment of the support device according to the invention, the container not being shown.

In FIG. 6 a further embodiment of the support device of the invention is shown schematically in perspective, which is currently the preferred embodiment due to its structural simplicity and its relatively low cost. In FIG. 6, the support device is shown in the stowed arrangement and configuration of a container, but the container is not illustrated to make the drawing more easily legible. In FIG. 6, the same reference numerals are retained to denote those parts identical to the corresponding parts of FIGS. 1 to 4.

In the embodiment illustrated in FIG. 6, the bases 4 remain substantially identical to how they were in the embodiment of FIGS. 1 to 4. The stowing means 3, in contrast, are different and are in this case formed by at least one deformable cable 28 (for example steel cable, in particular of the type known as a "bicycle cable", cable of synthetic material) which extends from one base 4*a* to the other 4*b*. One end 29 of said cable 28 is fixed by releasable fixing means 23 which may be arranged as mentioned above.

The length of the cable 28 is adjustable according to the distance between the two bases so that the cable 28 may tightly span the container and prevent said container from lifting up from the plate. Advantageously, the cable 28 is initially configured with a maximum length and comprises, at least in the vicinity of one of its ends or of its two ends, one or more separable sections allowing its useful length to be adjusted.

In a practical embodiment which is illustrated in FIG. 6, the cable 28 is doubled up in a substantially V-shaped configuration, so that the two ends 30 arranged in a V-shape retain the container more effectively. The point of the V thus constitutes the aforementioned end 29 which is retained by the releasable fixing means 23. Said releasable fixing means 23 may be attached, for example by means of screwing or bolting means 31, to a tab 32 of the base 4*b*. In contrast, the two free ends of the cable 28 are fixed to the other base 4*a*: for example they pass through two apertures made in the base 4*a* and at a distance from one another, said apertures being able, in particular, to be open in the central blocks 14 or even (in the case shown in FIG. 6) be formed by rings 33 attached to the external face of the blocks 14. The two free ends of the cable 28 are joined together by adjustable tensioning means 34, such as a reverse double threaded tensioning device 35, which allow the cable 28 to be tensioned on the container.

What is claimed is:

1. Support device for supporting a container enclosing at least one pneumatic life raft in a deflated and folded condition, said device comprising a support plate adapted to support said container and stowing means adapted to fix the container to the support plate, wherein the support plate comprises two separate, generally plate-shaped bases, arranged opposite one another substantially in line with one another and at a distance from one another, wherein the stowing means comprise a vertical limb comprising a fixed section secured to one of the bases at a first end and engaged with a first sliding section, wherein the first end is feely rotatable with respect to the base; the first sliding section forming an L-shaped bend having a vertical portion and a horizontal portion, wherein the vertical portion is configured to slide freely up and down the vertical limb in order to adjust the height of the support device, and wherein the horizontal portion comprises a stationary principal section;

the stationary principal section engaged with a second sliding section, the second sliding section configured to slide freely back and forth along the stationary principal section in order to adjust the length of the support device, whereby the support device may support containers having various heights and lengths.

2. Support device according to claim 1, wherein transverse blocking means are provided and adapted to block the container in a direction transverse to the extent of the stowing means.

3. Support device according to claim 2, intended to support containers of generally overall parallelepipedal shape, in particular rectangular parallelepipedal shape, wherein the transverse blocking means comprise at least two pairs of lateral blocks respectively provided on the two bases, and wherein the two blocks of one pair are provided on one respective base while being distant from one another with a distance corresponding substantially to a width of the container so as in use to be located on both sides of the container along a width thereof.

4. Support device according to claim 3, wherein each base further comprises at least one central block that is not aligned with said two lateral blocks, and wherein in use said blocks are adapted to cooperate with one respective end of the container.

5. Support device according to claim 2, wherein each base is manufactured from a cut and formed sheet metal plate, and wherein the blocking means are integral tabs that are lifted upwards and project over respective edges of said plate.

6. Support device according to claim 1, wherein said vertical limb of the at least one rigid bar has a variable adjustable height, whereby the support device may support containers having various heights.

7. Support device according to claim 1, wherein the horizontal arm of the at least one rigid bar has a telescopic structure.

8. Support device according to claim 1, wherein the vertical limb of the at least one rigid bar has a telescopic structure.

9. The support device of claim 1, further comprising a releasable fixing member, wherein the second sliding section has a sliding end cooperable with the stationary principal section and a free end cooperable with the releasable fixing member.

10. The support device of claim 9, wherein the releasable fixing member comprises a chain configured to engage the free end of the second sliding section and the other of the two bases.

* * * * *